US011759071B2

(12) United States Patent
Douglas et al.

(10) Patent No.: US 11,759,071 B2
(45) Date of Patent: Sep. 19, 2023

(54) CLEANING DEVICE

(71) Applicant: SharkNinja Operating LLC, Needham, MA (US)

(72) Inventors: Michael James Douglas, London (GB); Richard Mathias, Brookline, MA (US)

(73) Assignee: SharkNinja Operating LLC

( * ) Notice: Subject to any disclaimer, the term of this patent is extended or adjusted under 35 U.S.C. 154(b) by 861 days.

(21) Appl. No.: 16/671,220

(22) Filed: Nov. 1, 2019

(65) Prior Publication Data

US 2020/0138256 A1 May 7, 2020

Related U.S. Application Data

(60) Provisional application No. 62/754,453, filed on Nov. 1, 2018.

(51) Int. Cl.

| | |
|---|---|
| ***A47L 9/14*** | (2006.01) |
| ***A47L 9/06*** | (2006.01) |
| ***A47L 9/12*** | (2006.01) |

(52) U.S. Cl.

CPC ..... *A47L 9/1409* (2013.01); *A47L 9/066* (2013.01); *A47L 9/12* (2013.01)

(58) Field of Classification Search

None

See application file for complete search history.

(56) References Cited

U.S. PATENT DOCUMENTS

| | | | |
|---|---|---|---|
| 490,472 | A | 1/1893 | Clements |
| 2,055,734 | A | 9/1936 | Sparklin |
| RE20,489 | E | 8/1937 | Leathers |
| D117,388 | S | 10/1939 | Woinarovicz |
| 3,050,761 | A | 8/1962 | Morgan |
| D214,977 | S | 8/1969 | Roth |
| 3,814,124 | A | 6/1974 | Bell |
| 4,011,624 | A | 3/1977 | Proett |
| 4,063,326 | A | 12/1977 | Fromknecht |
| D247,949 | S | 5/1978 | Tillinghast et al. |

(Continued)

FOREIGN PATENT DOCUMENTS

| | | | |
|---|---|---|---|
| CN | 1764405 | A | 4/2006 |
| CN | 1889881 | A | 1/2007 |

(Continued)

OTHER PUBLICATIONS

International Search Report and Written Opinion received for PCT Application No. PCT/IB2020/062158, dated Mar. 24, 2021, 11 pages.

(Continued)

*Primary Examiner* — Thomas Raymond Rodgers
(74) *Attorney, Agent, or Firm* — MINTZ LEVIN COHN FERRIS GLOVSKY AND POPEO, PC

(57) ABSTRACT

Apparatus and method for receiving and holding debris in a collection chamber of a vacuum cleaner. The collection chamber has an inlet opening through which debris-entrained air enters the collection chamber. When the vacuum cleaner is off, the cover prevents debris from leaving the collection chamber through the inlet opening. The wall of the collection chamber moves when negative pressure is applied to the collection chamber, and the wall movement moves the cover from the inlet opening, allowing the debris-entrained air to enter the collection chamber. In some embodiments, the moving part of the wall is an air filter.

19 Claims, 11 Drawing Sheets

(56) References Cited

U.S. PATENT DOCUMENTS

| | | | |
|---|---|---|---|
| D250,245 | S | 11/1978 | Bebb |
| D278,099 | S | 3/1985 | Evans |
| 4,545,794 | A | 10/1985 | Himukai |
| 4,610,047 | A | 9/1986 | Dick et al. |
| 4,706,327 | A | 11/1987 | Getz et al. |
| 5,247,720 | A | 9/1993 | Sovis et al. |
| 5,365,881 | A | 11/1994 | Sporn |
| 5,664,285 | A | 9/1997 | Melito et al. |
| 5,829,090 | A | 11/1998 | Melito et al. |
| D423,157 | S | 4/2000 | Hodges |
| 6,102,278 | A | 8/2000 | Rothas |
| 6,117,200 | A | 9/2000 | Berg et al. |
| 6,453,506 | B1 | 9/2002 | Sumner |
| 6,571,421 | B1 | 6/2003 | Sham et al. |
| 6,797,357 | B2 | 9/2004 | Fereshtehkhou et al. |
| 6,799,351 | B2 | 10/2004 | Porath |
| 6,966,098 | B2 | 11/2005 | Sako et al. |
| 7,013,528 | B2 | 3/2006 | Parker et al. |
| 7,048,804 | B2 | 5/2006 | Kisela et al. |
| 7,137,169 | B2 | 11/2006 | Murphy et al. |
| 7,150,069 | B2 | 12/2006 | Hori et al. |
| D548,907 | S | 8/2007 | Killen |
| 7,293,322 | B2 | 11/2007 | Matousek et al. |
| 7,329,294 | B2 | 2/2008 | Conrad |
| 7,337,494 | B2 | 3/2008 | Baer et al. |
| 7,409,745 | B2 | 8/2008 | Dodson et al. |
| 7,418,763 | B2 | 9/2008 | Shaver et al. |
| 7,451,519 | B2 | 11/2008 | Nishinaka et al. |
| D597,717 | S | 8/2009 | Rosenzweig et al. |
| 7,673,361 | B2 | 3/2010 | Policicchio et al. |
| 7,676,877 | B2 | 3/2010 | Policicchio et al. |
| 7,861,351 | B2 | 1/2011 | Ho |
| 7,934,287 | B2 | 5/2011 | De Soto-Burt et al. |
| 8,020,236 | B2 | 9/2011 | Kaleta et al. |
| 8,062,398 | B2 | 11/2011 | Luo et al. |
| 8,065,778 | B2 | 11/2011 | Kim et al. |
| D661,034 | S | 5/2012 | Ediger et al. |
| D672,107 | S | 12/2012 | Van Landingham, Jr. et al. |
| 8,341,802 | B2 | 1/2013 | Kim et al. |
| 8,458,850 | B2 | 6/2013 | Kasper et al. |
| 8,495,781 | B2 | 7/2013 | Dingert |
| 8,584,309 | B2 | 11/2013 | Santiago |
| D703,407 | S | 4/2014 | Xiong |
| 8,769,764 | B2 | 7/2014 | Crouch et al. |
| D731,137 | S | 6/2015 | Colangelo |
| D764,127 | S | 8/2016 | Vicari et al. |
| D766,584 | S | 9/2016 | Blouin et al. |
| 9,504,366 | B2 | 11/2016 | Kasper et al. |
| 9,545,180 | B2 | 1/2017 | Conrad |
| 9,560,944 | B2 | 2/2017 | Grey |
| 9,661,968 | B2 | 5/2017 | Bradbury |
| 9,788,695 | B2 | 10/2017 | Wood |
| D804,123 | S | 11/2017 | Orsino |
| 9,883,780 | B2 | 2/2018 | Kim et al. |
| 9,901,231 | B2 | 2/2018 | Tibberts |
| D817,574 | S | 5/2018 | Libman et al. |
| 2003/0159230 | A1 | 8/2003 | Oh |
| 2003/0217432 | A1 | 11/2003 | Oh et al. |
| 2003/0221274 | A1 | 12/2003 | Makhija et al. |
| 2004/0045126 | A1 | 3/2004 | Parker et al. |
| 2004/0134016 | A1 | 7/2004 | Kisela et al. |
| 2004/0134025 | A1 | 7/2004 | Murphy et al. |
| 2004/0139572 | A1 | 7/2004 | Kisela et al. |
| 2004/0141798 | A1 | 7/2004 | Garabedian et al. |
| 2004/0168281 | A1 | 9/2004 | Sako et al. |
| 2004/0211022 | A1 | 10/2004 | Fan |
| 2004/0250376 | A1 | 12/2004 | Hori et al. |
| 2005/0115409 | A1 | 6/2005 | Conrad |
| 2005/0132680 | A1 | 6/2005 | Wegelin et al. |
| 2005/0193516 | A1 | 9/2005 | Hughes |
| 2006/0000052 | A1 | 1/2006 | Budd |
| 2006/0123590 | A1 | 6/2006 | Fester et al. |
| 2006/0135026 | A1 | 6/2006 | Arendt et al. |
| 2007/0061040 | A1 | 3/2007 | Augenbraun et al. |
| 2007/0245511 | A1 | 10/2007 | Hahm et al. |
| 2007/0251050 | A1 | 11/2007 | Harsh et al. |
| 2008/0040876 | A1 | 2/2008 | Aiyar |
| 2008/0235899 | A1 | 10/2008 | Haan |
| 2008/0276407 | A1 | 11/2008 | Schnittman et al. |
| 2009/0100636 | A1 | 4/2009 | Sohn et al. |
| 2010/0024155 | A1 | 2/2010 | Policicchio et al. |
| 2010/0024156 | A1 | 2/2010 | De et al. |
| 2010/0024157 | A1 | 2/2010 | Vemon et al. |
| 2010/0115719 | A1 | 5/2010 | West et al. |
| 2010/0251497 | A1 | 10/2010 | Arnold |
| 2010/0251505 | A1 | 10/2010 | Vrdoljak et al. |
| 2010/0306939 | A1 | 12/2010 | Dingert |
| 2011/0088209 | A1 | 4/2011 | Ivarsson |
| 2012/0110775 | A1 | 5/2012 | Krebs |
| 2012/0159728 | A1 | 6/2012 | Suda et al. |
| 2012/0211625 | A1 | 8/2012 | Schultink et al. |
| 2012/0311813 | A1 | 12/2012 | Gilbert et al. |
| 2013/0055521 | A1 | 3/2013 | Lee et al. |
| 2013/0291333 | A1 | 11/2013 | Grey |
| 2014/0033470 | A1 | 2/2014 | Codling |
| 2014/0033471 | A1 | 2/2014 | Toole et al. |
| 2015/0101617 | A1 | 4/2015 | Duffy |
| 2015/0128364 | A1 | 5/2015 | Dooley et al. |
| 2015/0223662 | A1 | 8/2015 | Doherty-Stapp et al. |
| 2015/0250368 | A1 | 9/2015 | Kim et al. |
| 2016/0100735 | A1 | 4/2016 | Milanese et al. |
| 2016/0174793 | A1 | 6/2016 | Burke et al. |
| 2016/0278594 | A1 | 9/2016 | Bradbury |
| 2016/0353963 | A1 | 12/2016 | Kellis et al. |
| 2017/0007086 | A1 | 1/2017 | Kleine-Doepke et al. |
| 2017/0119223 | A1 | 5/2017 | Staf |
| 2017/0202421 | A1 | 7/2017 | Hwang et al. |
| 2018/0014711 | A1 | 1/2018 | Rostami |
| 2018/0035855 | A1 | 2/2018 | Wood |
| 2018/0055315 | A1 | 3/2018 | Conrad |
| 2018/0177367 | A1 | 6/2018 | Amaral et al. |
| 2018/0220861 | A1 | 8/2018 | Zhang et al. |
| 2019/0269289 | A1 | 9/2019 | Xu et al. |
| 2019/0274500 | A1 | 9/2019 | Thorne et al. |

FOREIGN PATENT DOCUMENTS

| | | | |
|---|---|---|---|
| CN | 101061929 | A | 10/2007 |
| CN | 102112030 | A | 6/2011 |
| CN | 102961085 | A | 3/2013 |
| CN | 103356140 | A | 10/2013 |
| CN | 205181229 | U | 4/2016 |
| CN | 107028564 | A | 8/2017 |
| CN | 209595637 | U | 11/2019 |
| DE | 667452 | C | 11/1938 |
| EP | 1027844 | A2 | 8/2000 |
| EP | 1219222 | A1 | 7/2002 |
| EP | 1525839 | A2 | 4/2005 |
| EP | 1980188 | A2 | 10/2008 |
| GB | 2161902 | A | 1/1986 |
| GB | 2508541 | A | 6/2014 |
| JP | 2003326121 | A | 11/2003 |
| JP | 2006198083 | A | 8/2006 |
| JP | 2008206944 | A | 9/2008 |
| JP | 2008228768 | A | 10/2008 |
| JP | D1489801 | S | 2/2014 |
| JP | 2014200435 | A | 10/2014 |
| KR | 1020060112749 | A | 11/2006 |
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2010014366 | A1 | 2/2010 |
| WO | 2010014367 | A1 | 2/2010 |
| WO | 2011017493 | A2 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |

(56) References Cited

FOREIGN PATENT DOCUMENTS

| | | |
|---|---|---|
| WO | 2016100964 A2 | 6/2016 |
| WO | 2017144918 A1 | 8/2017 |

OTHER PUBLICATIONS

Extended European Search Report issued in European Application No. 21212780.7, dated Apr. 4, 2022, 5 pages.
Extended European Search Report for Application No. 19880507.9 dated Jul. 22, 2022, 5 pages.
(2016) Amazon.com—Shark Genius Steam Pocket Mop Hard Floor Cleaner, oldest reviews 2016, https:/lwww.amazon.com/cleaner-Blaster-Technology-Intelligent-S5003D/dp/B01 KU4BSGK/ref=cm_crarp_d_product_top?ie=UTF8, 11 pages.
Extended European Search Report received for EP Application No. 18854457.1, dated Apr. 2, 2020, 5 pages.
Extended European Search Report received for EP Application No. 19215569.5, dated May 15, 2020, 5 pages.
International Preliminary Report on Patentability received for PCT Application No. PCT/US2018/050308, dated Mar. 26, 2020, 13 pages.
International Search Report and Written Opinion received for PCT Application No. PCT/US2019/059327, dated Feb. 6, 2020, 10 pages.
International Search Report and Written Opinion received for PCT Application No. PCT/US2018/050308, dated Nov. 26, 2018, 15 pages.
International Search Report and Written Opinion received for PCT Application No. PCT/US2019/067121, dated May 7, 2020, 12 pages.
International Search Report and Written Opinion received for PCT Application No. PCT/US2020/058146, dated Feb. 2, 2021, 13 pages.
International Search Report and Written Opinion received for PCT Application No. PCT/US2020/058162, dated Feb. 2, 2021, 12 pages.
International Search Report and Written Opinion received for PCT Application No. PCT/US2020/059491, dated Feb. 2, 2021, 9 pages.
International Search Report and Written Opinion received for PCT Application No. PCT/US2020/059503, dated Feb. 3, 2021, 7 pages.
International Search Report and Written Opinion received in PCT Application No. PCT/US2020/058195, dated Dec. 21, 2020, 13 pages.
Invitation to Pay Additional Fees received for PCT Application No. PCT/US2020/062158, dated Jan. 11, 2021, 2 pages.
(Aug. 1, 2019) N.K. Multi-Tech Filters Pvt. Limited, Available at: https://www.airfiltersindia.net/product_temp_No_Upload.html, 4 Pages.

CLEANING DEVICE

CROSS-REFERENCE TO RELATED APPLICATIONS

This application claims priority under 35 U.S.C. § 119(e) to U.S. Provisional Application No. 62/754,453, entitled "CLEANING DEVICE" and filed Nov. 1, 2018, the entirety of which is incorporated herein by reference.

FIELD

Embodiments disclosed herein related generally to cleaning devices, and more specifically to vacuums and cleaning heads for vacuums.

DESCRIPTION OF THE RELATED ART

Cleaning devices are used in the home and office to clean floors and other surfaces. Various types of cleaning devices are known, such as vacuums with disposable bags, and vacuums with dirt bins that can be emptied and re-used.

SUMMARY

According to one embodiment, an apparatus includes a debris collection chamber, an air filter configured to allow air to pass through the air filter while inhibiting debris from passing through the air filter, and a collection chamber inlet opening configured to allow debris-entrained air to flow into the collection chamber. The air filter is movable from a first position, in which the air filter covers the chamber inlet opening, to a second position in which the air filter does not cover the chamber inlet opening.

According to another embodiment, an apparatus adapted to be attached to a vacuum cleaner includes a debris collection chamber and a collection chamber inlet opening configured to allow debris-entrained air to flow into the debris collection chamber. The apparatus also includes an air filter configured to allow air to pass through the air filter while inhibiting debris from passing through the air filter. A cover is provided which is movable from a first position in which the cover covers the chamber inlet opening, to a second position in which the cover does not cover the chamber inlet opening. The cover is attached to the air filter, and the air filter is arranged such that when the air filter is under no negative pressure, the cover is in the first position. The air filter is also arranged such that when negative pressure is applied to the air filter to draw air through the chamber inlet opening, the air filter moves the cover to the second position.

According to yet another embodiment, an apparatus adapted to be attached to a cleaning device having a suction source is provided. The apparatus includes a debris collection chamber having a chamber wall that moves when negative pressure is applied to the collection chamber, and a collection chamber inlet opening configured to allow air to flow into the debris collection chamber when negative pressure is applied to the debris collection chamber. The apparatus also includes a cover movable from a first position, in which the cover covers the chamber inlet opening, to a second position in which the cover does not cover the chamber inlet opening. The cover is attached to the chamber wall and arranged such that when the chamber wall moves due to the negative pressure being applied the collection chamber, the chamber wall moves the cover from the first position to the second position in which the cover does not cover the chamber inlet opening, and a flow path is opened for debris-entrained to be drawn into the collection chamber through the chamber inlet opening.

According to another embodiment, a method includes attaching a debris collection chamber to a vacuum cleaner, the collection chamber including a movable wall, a collection chamber inlet opening, and an inlet opening cover operatively connected to the movable wall. The method further includes activating a suction source that applies a negative pressure to the debris collection chamber and moves the movable wall, wherein the movement of the wall in response to the application of the negative pressure moves the inlet opening cover from a first position in which the inlet opening cover covers the inlet opening, to a second position in which the inlet opening cover does not cover the inlet opening. Also included are acts of deactivating the suction source, and removing the debris collection chamber from the vacuum cleaner.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
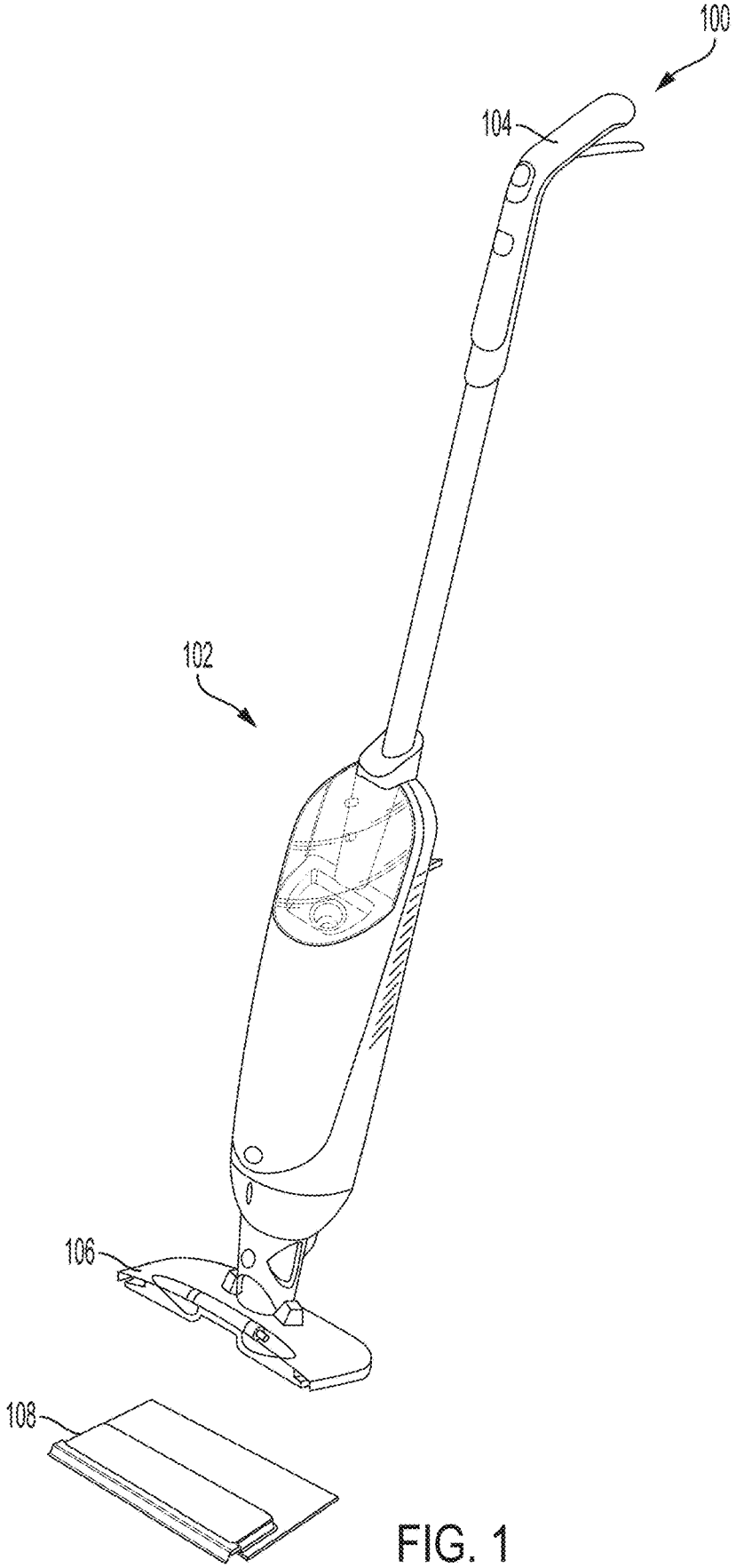
FIG. 1 is a perspective view of a cleaning device according to embodiments of the present disclosure.

Conventional bag vacuums typically require the user to remove a bag from a housing interior, dispose of the bag, and insert a new bag. Removing the bag can put dust in the air and/or result in spilled debris. Cyclonic vacuum cleaners often have a debris collection chamber that can be removed from the body of the vacuum, emptied, and reused.

For cleanup jobs that do not require a full size vacuum cleaner, the inventors have appreciated that a debris collection container which remains closed upon removal from the vacuum can be helpful. Disclosed herein are debris collection chamber arrangements which allow debris-entrained air to enter a collection chamber through an inlet opening when the vacuum cleaner is turned on. The collection chamber arrangements cover the inlet opening when the vacuum cleaner is turned off, which limits undesirable release of debris from the collection chamber. In some embodiments, the collection chamber is disposable, and in some embodiments, the collection chamber is attached to a cleaning head, and the entire cleaning head is disposable.

To facilitate covering the collection chamber inlet opening, a cover for the inlet opening may be arranged to move in response to the presence of negative pressure in the vacuum cleaner. For example, a planar piece of filter material may cover the inlet opening when the vacuum cleaner is off. When the vacuum cleaner is turned on and negative pressure is applied to the filter material, the filter material pulls away from the inlet opening, thereby allowing air and debris to enter the collection chamber. The inflow of air substantially prevents dirt from exiting the collection chamber through the inlet opening. When the vacuum cleaners turned off, the filter material returns to its position covering the inlet opening. Such an arrangement provides for covering the inlet opening without user intervention.

In some embodiments, the filter material is attached to the debris collection chamber with an elastic connector. The elastic connector allows the filter material to be pulled away from the inlet opening when the filter material is subjected to a negative pressure by a suction source. In other embodiments, no elastic connection is provided, and the inherent flexibility of the filter material allows the filter material to move away from the inlet opening.

In some embodiments, the cover for the inlet opening is not filter material. For example, a piece of filter material may form substantially the entire top wall of a collection chamber, but include an air impermeable portion which covers and uncovers the inlet opening. In still other embodiments, an entire top wall of the collection chamber may be formed of a flexible material other than an air filter. The top wall may move to cover and uncover the inlet opening, while a separate portion of the collection chamber has an air outlet that applies a negative pressure to the collection chamber.

By automatically closing the chamber inlet opening when the vacuum cleaner is turned off, the collection chamber may be completely enclosed to limit release of debris. The arrangement can also be helpful to limit spillage or egress of collected debris from the collection chamber when the user removes and/or transports the collection chamber for debris disposal. In some embodiments, the collection chamber may be adapted for reuse and include an aperture which is selectively openable to discard debris from the chamber. In other embodiments, the collection chamber may be adapted to be disposed of once the chamber is full. For example, in some embodiments the collection chamber may have no openings other than the inlet opening. In some embodiments, the collection chamber is not openable by a user to dispose of debris from the debris collection chamber without damaging the debris collection chamber. The collection chamber may be permanently attached to, and form at least a portion of, a disposable cleaning head in some embodiments, such that the entire head is disposed of after use.

For purposes herein, debris being suctioned into the debris collection chamber may include dry and/or wet media. For example, in some embodiments, a liquid applied to the surface may be absorbed by a cleaning sheet and/or suctioned by the vacuum into the debris collection chamber. In some embodiments, the wet media may be absorbed by at least a portion of the material used to form the debris collection chamber. In some embodiments, the debris collection chamber may be formed of a material which allows for fluid absorption into the material but does not allow for liquid transfer through the material. In such embodiments, liquid may not travel through the debris collection chamber. For example, the material used to form the debris collection chamber may be absorptive on an inner side of the debris collection chamber, but liquid impermeable.

Advantages also may be realized if the user does not have to handle the wet or dirty cleaning head after operation of the cleaning device. For example, the cleaning device may be arranged to release the cleaning head after using the cleaning device such that the user does not have to grasp the cleaning head to discard it. With a permanently attached debris collection chamber, and a release arrangement that does not require the user to touch the cleaning head, the cleaning head can be disposed of with limited or no user contact.

In some embodiments, the cleaning head includes a support structure to which the debris collection chamber is attached. In such embodiments, the user may simply attach the cleaning head to the cleaning device, operate the cleaning device to move dirt from the surface and into the debris collection chamber, remove the cleaning head, and dispose of the cleaning head in a trash receptacle.

In some embodiments, the cleaning heads are arranged for space-efficient stacking for ease of storage and transport. In some embodiments, the dirt collection chambers are arranged to be collapsible. For example, the dirt collection chamber may include a bag.

FIG. 1 shows a cleaning device 100 according to some embodiments of the present disclosure. The cleaning device 100 includes a body 102 with a handle 104, a connector 106, and a cleaning head 108 which is removably attachable to the body, such as via the connector. In some embodiments, the handle may have a length that is adjustable to allow a user to adjust the height of the cleaning device.

Figure 2:
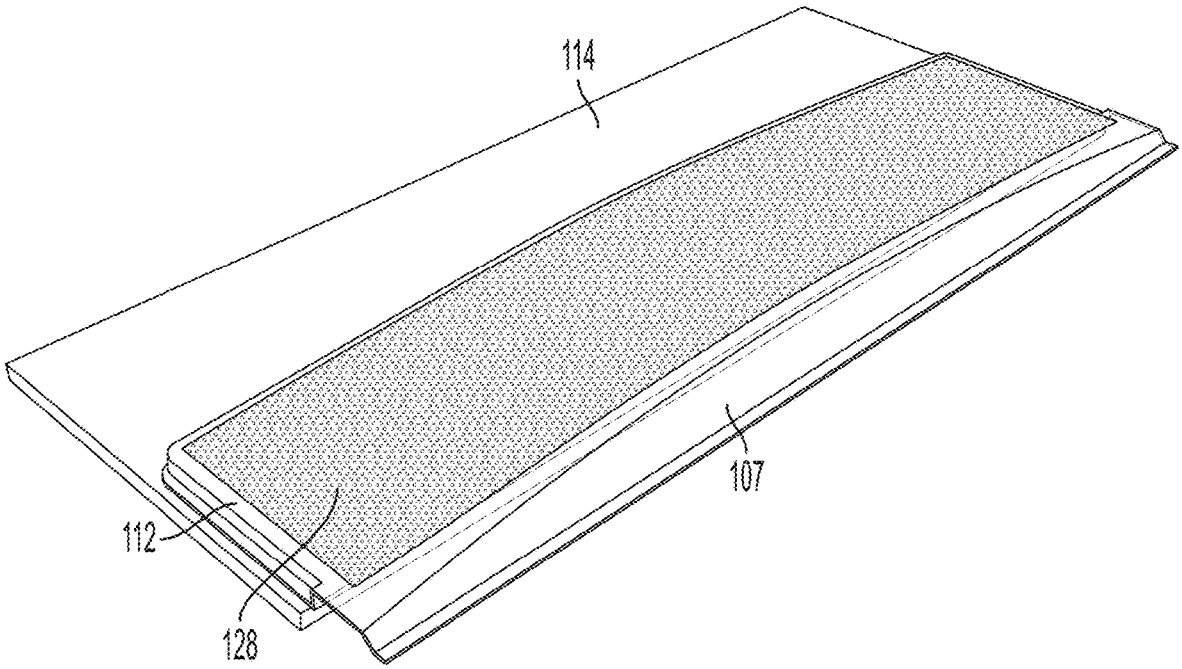
FIG. 2 is a top, front perspective view of a cleaning head according to some embodiments.
Figure 3:
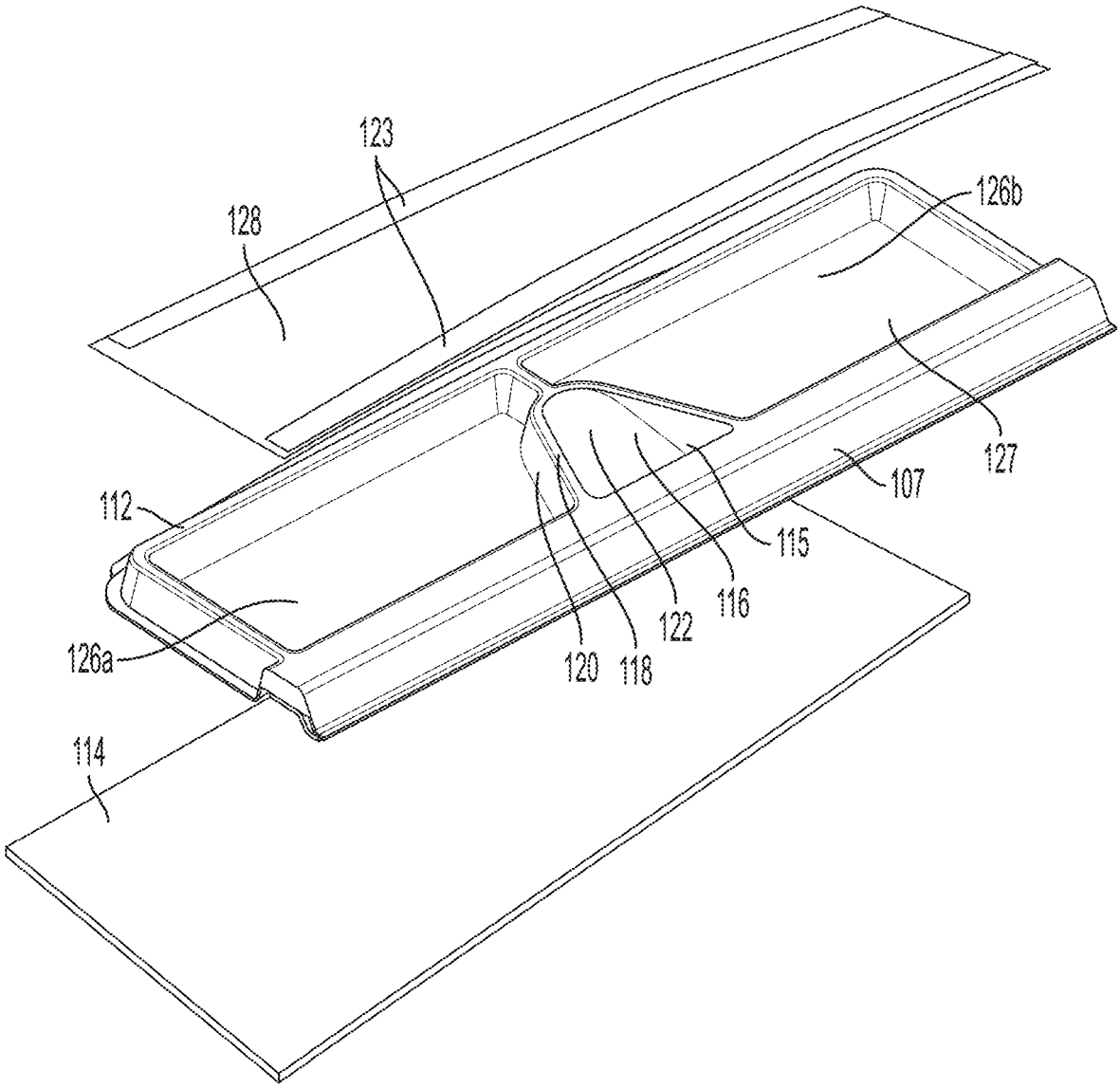
FIG. 3 is an exploded view of the cleaning head of FIG. 2.
Figure 4:
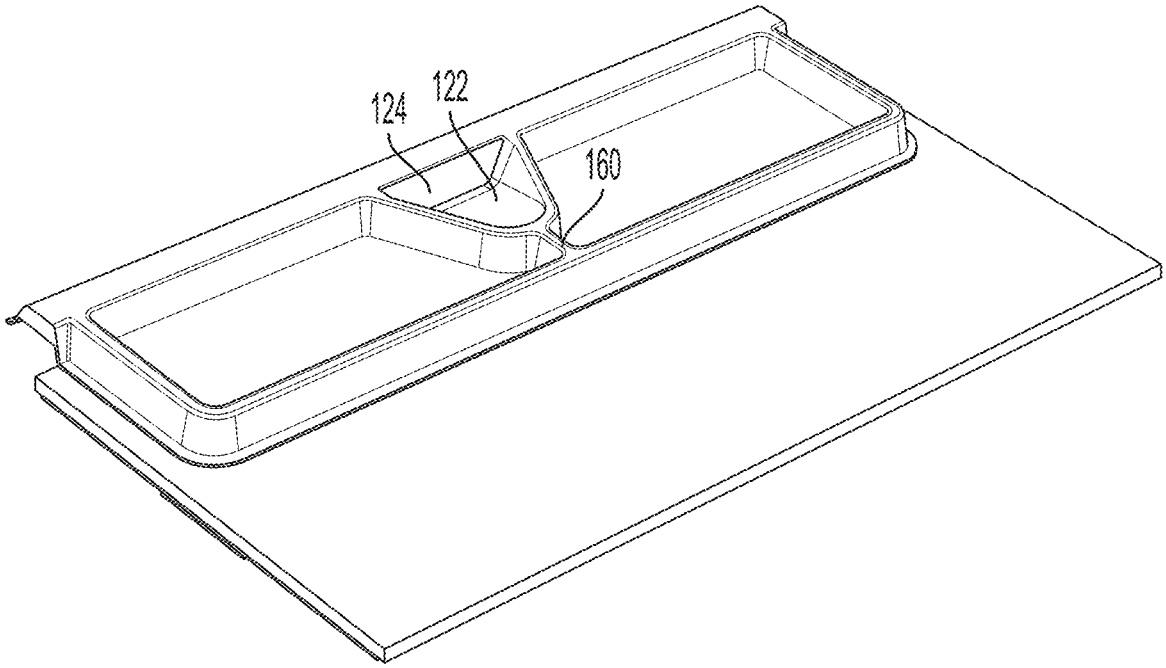
FIG. 4 is a top, rear perspective view of the cleaning head of FIG. 2 with the filter removed.

As shown in FIGS. 2-4, the cleaning head 108 may include a suction nozzle 107 to remove debris from a surface, and a debris collection chamber 112 to collect the debris removed from the surface. As will be appreciated, the debris collection chamber may be any suitable type of container for collecting debris such as dirt, dust, food, or wet media. In some embodiments, the debris collection chamber 112 may be permanently or removably attached to a cleaning sheet 114. For example, the collection chamber 112 may be glued, heat sealed, or otherwise permanently affixed to cleaning sheet 114.

In some embodiments, an additional support structure may be provided. For example, a substantially planar support frame may be provided between the collection chamber and the sheet, although the support structure may have other suitable arrangements.

In some embodiments, the collection chamber 112 protrudes upwardly from the cleaning sheet or support structure. For purposes herein, the term "protruding upwardly" means that the collection chamber protrudes away from the support structure in a direction away from the surface being cleaned.

The collection chamber 112 includes an inlet 115 having an inlet opening 116, which in the illustrated embodiment, is located at a top portion of the collection chamber 112. The inlet opening 116 is formed by a top rim 118 of an upwardly extending wall 120. The inlet 115 may have a ramp 122 extending from a suction inlet 124 into the collection chamber to aid in moving debris from the suction inlet into collection areas 126*a,* 126*b* of the collection chamber. Though in some embodiments the area below the inlet opening may have a floor that is coplanar with a bottom 127 of the collection portions of the collection chamber 112.

An air filter 128 forms a top wall of the collection chamber in some embodiments. The filter material may be attached to the collection chamber such that in a first position, as shown in FIG. 2, the air filter covers inlet opening 116. In this position, the air filter inhibits debris that has already been collected in collection areas 126*a,* 126*b* from moving over wall 120 and through the inlet opening 116. The air filter and the collection chamber are arranged such that the air filter is in this first position when negative pressure is not being applied to the air filter.

When negative pressure is applied to the air filter, the air filter moves upwardly (see FIG. 5) and separate from the inlet opening. In this second position, debris-entrained air can flow through suction inlet 124, up and over wall 120, and into the debris collection areas 126*a,* 126*b*.

Figure 5:
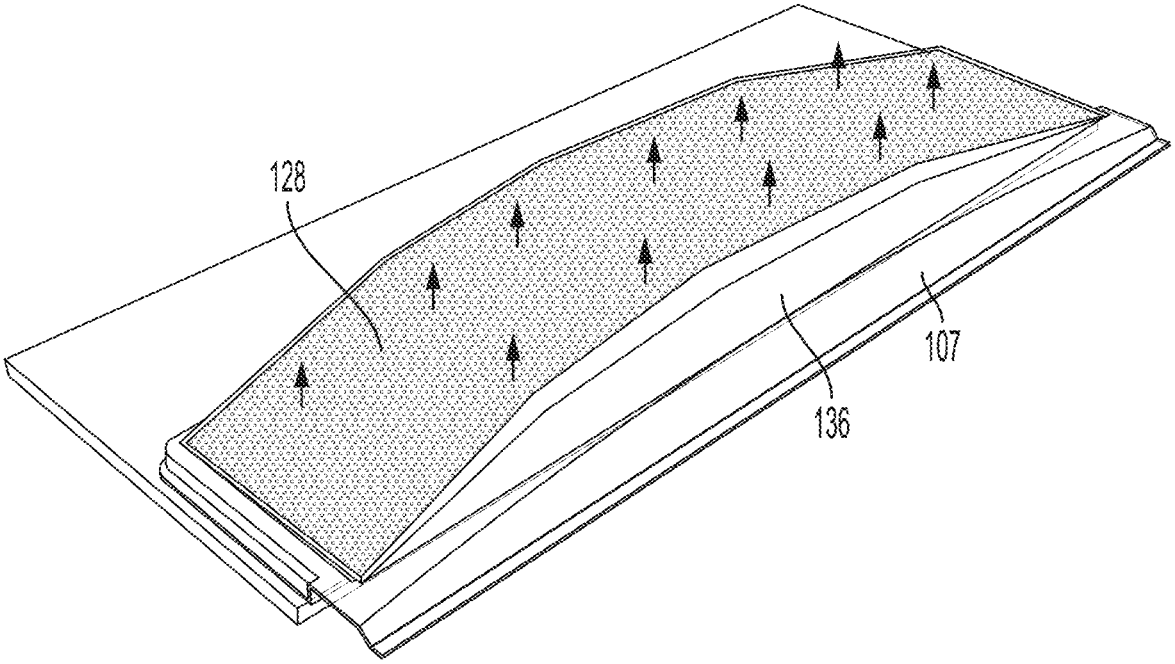
FIG. 5 shows the cleaning head of FIG. 2 in a state where negative pressure is being applied to the collection chamber.
Figure 6:
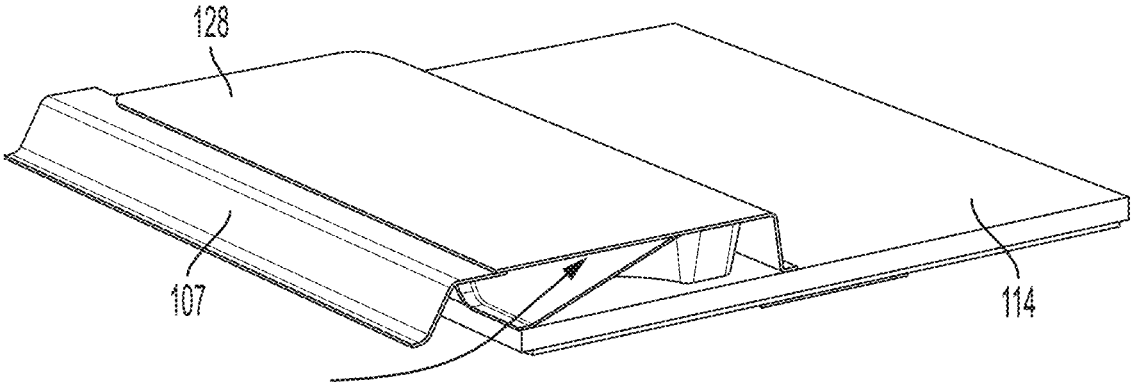
FIG. 6 is a cutaway view of the cleaning head of FIG. 2.

As mentioned above, the air filter may be attached to the collection chamber with an elastic connection. For example, as shown in FIG. 5, an elongated strip 136 of elastic material connects the air filter to a top portion of the collection chamber along a front wall of the collection chamber. A similar elongated elastic strip (not visible in FIG. 5) connects the air filter to the top portion of the collection chamber along the rear wall of the collection chamber. The stretchability of the elongated strips allows the air filter to move away from the inlet opening. In some embodiments, elastic connectors may be used on one or both of the walls at the lateral sides of the collection chamber.

In some embodiments, only a portion of the air filter 128 may rise from the collection chamber when negative pressure is applied to the cleaning head. For example, elastic connectors may be provided along only certain portions of the air filter. The elastic portions may be provided in an area of the air inlet opening such that the air filter lifts only in the area at or near the air inlet opening, while the remaining areas of the air filter are not substantially lifted.

In still further embodiments, the air filter may be connected to the collection chamber without any elastic connectors such that the air filter does not move at the connection points. In such an embodiment, the air filter may have a size and shape which allows the air filter to sufficiently lift away from the air inlet opening when under negative pressure such that the cover lifts away from the air inlet opening. For example, adhesive strips 123 may be provided on the filter material 128, to secure the filter material to the collection chamber, as shown by way of example in FIG. 3.

Figure 7:
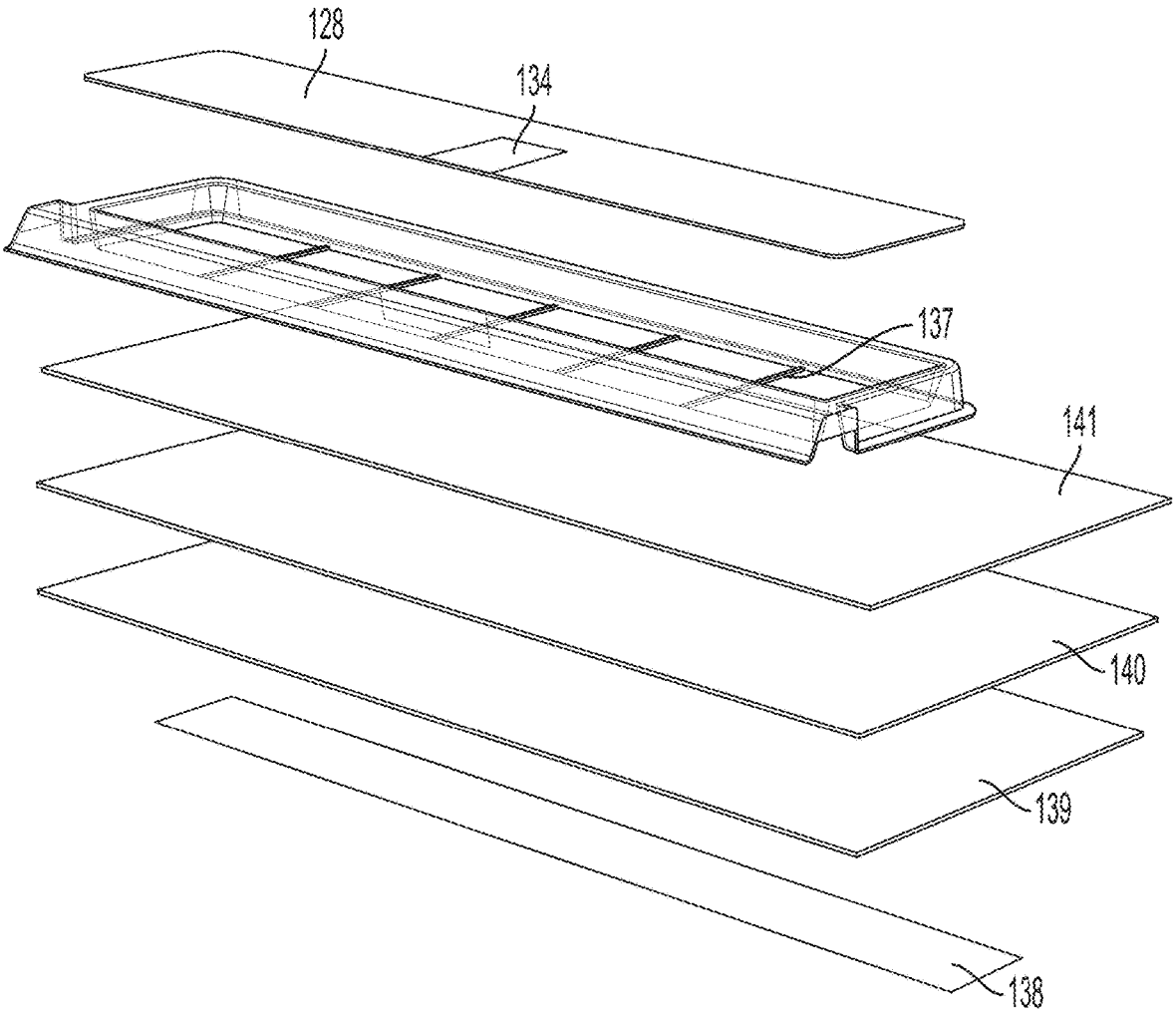
FIG. 7 is an exploded view of the cleaning head and sheet assembly.

Materials other than an air filter may be used to cover the inlet opening in some embodiments. For example, as shown in FIG. 7, a section of air impermeable material may be used in the area of the top wall of the collection chamber as a cover 134 for the inlet opening. Cover 134 may have the same shape as a perimeter of the chamber inlet opening, or it may have a different shape. In some embodiments, an underside of cover 134 may be provided with an additional material layer. For example, a layer of material which conforms easily to rim 118 may be adhered to an underside of the air filter. Such a layer may act to seal the inlet opening against passage of debris.

The portions of the top wall outside of the cover 134 are shown as air filter 128 in the embodiment of FIG. 7, but other materials may be used to form the top wall of the collection chamber. In some embodiments, the entire top wall may be air impermeable, and one or more air filters may be provided elsewhere in the arrangement, as discuss below with reference to FIG. 11.

The collection chamber may include stiffening ridges 137 along a bottom of the collection chamber. The stiffening ridges may allow for less material to be used in forming the collection chamber. The stiffening ridges are shown traveling from front to back in the collection chamber, however, stiffening ridges may be positioned and sized in any suitable manner. Stiffening grooves may be used instead of, or in addition to, stiffening ridges. In some embodiments, the collection chamber is formed with a plastic thermoforming process. The collection chamber may be manufactured using any suitable process. For example, the collection chamber may be injection molded. In some embodiments, the collection chamber, the suction nozzle, and the suction inlet may be a unitary piece. In some embodiments, the collection chamber, the suction nozzle, and the inlet may be integrally formed, such as by thermoforming. In other embodiments, one more of the collection chamber, the suction nozzle, and the suction inlet may be separately formed and attached.

As mentioned above, a cleaning sheet may be attached to the collection chamber. The cleaning sheet may be formed of any suitable material, and may be made of a single layer or multiple layers. In the illustrated embodiment, the cleaning sheet includes multiple layers including a multifunctional strip 138, a face layer 139, and first and second absorbent layers 140 and 141. The face layer and absorbent layers may be made from various non-woven materials, woven materials, and/or plastics, or any other suitable materials. The absorbent layers may be configured to wick moisture away from the face layer. The multifunctional strip 138 may be used for scrubbing in some embodiments. In some embodiments, the multifunctional strip may provide friction to help prevent the cleaning device from slipping when propped against a wall.

In some embodiments, the air filter material may be limited to specific sections of the collection chamber. For example, a top chamber wall similarly arranged to the air filter 128 shown in FIG. 7 may have air permeable sections only at or near lateral ends of the top chamber wall, and have air impermeable material in the remaining section. In other embodiments, air permeable sections may be positioned close to a centered inlet opening on both sides of the inlet opening. In still other embodiments, a collection chamber may include more than one inlet opening and a cover for each of the openings.

A cover may include portions which extended downwardly into the inlet opening and/or around the outside of the chamber inlet opening. For example, a collar may be attached to an underside of the air filter such that when the vacuum cleaner is turned off and the air filter returns to a home position, the collar cover some or all of the perimeter of the inlet opening.

Figure 8:
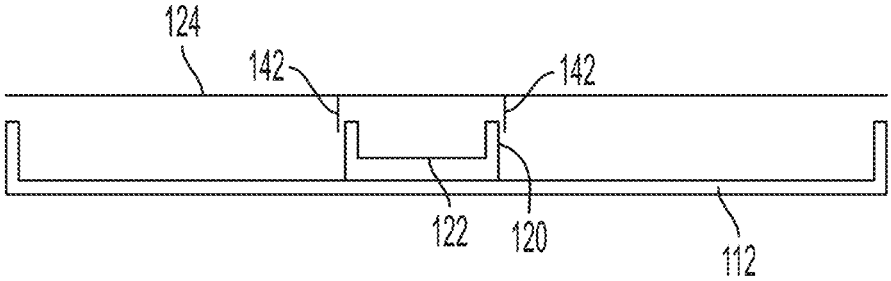
FIG. 8 is a cross-sectional front view of a cleaning head and a partially lifted top chamber wall according to some embodiments.

One example of such an embodiment is shown in FIG. 8. A collar 142 is connected to an underside of air filter 124. When the air filter is moved to a home position, the collar is positioned next to, or in contact with, an outside of wall 120. The air filter and is shown slightly higher than the home position in FIG. 8. The collar may be made of a rigid material or may be made of a flexible material.

Figure 9:
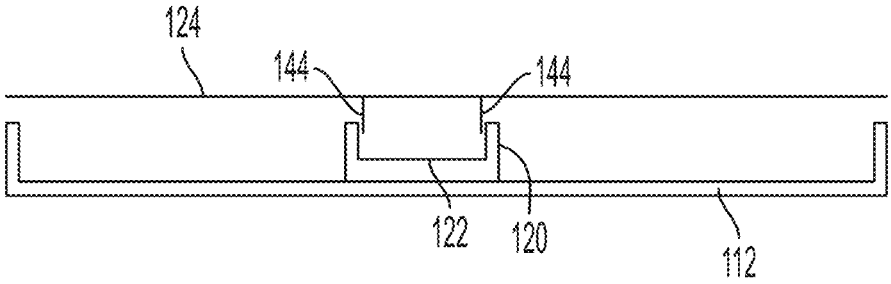
FIG. 9 is a cross-sectional front view of a cleaning head and a partially lifted top chamber wall according to alternative embodiments.

FIG. 9 shows an embodiment where a downwardly extending member is positioned inside the inlet opening when the air filter is in the home position. A collar 144 is adapted to be positioned next or in contact with an inside of wall 120. As with the embodiment illustrated in FIG. 8, the collar may be made of a rigid material or a flexible material. The downwardly extending cover structures shown in FIGS. 8 and 9 may be used in addition to or instead of a substantially horizontal cover portion of the air filter.

Figure 10:
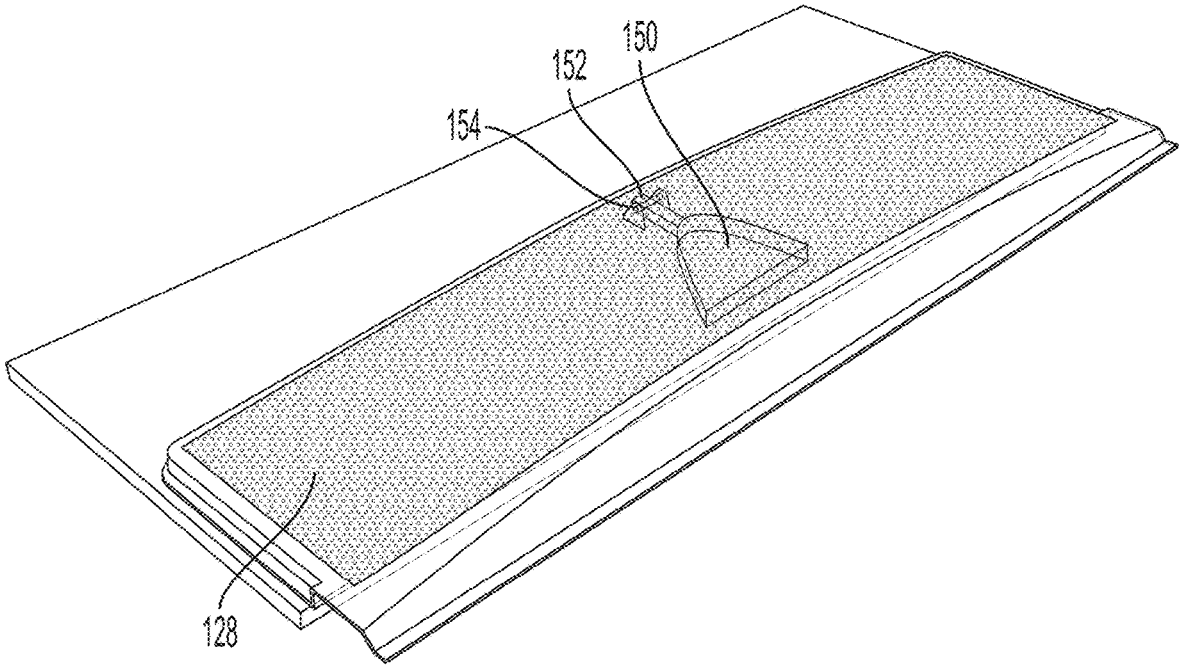
FIG. 10 shows a cover stabilizer according to some embodiments.

A cover stabilizer may be implemented to help maintain contact between the cover and the rim of the inlet opening. For example, as shown in FIG. 10, a cover stabilizer 150 has a similar shape to the rim of the outlet opening shown in FIGS. 3-4. Stabilizer 150 is pivotally attached to the air filter at a pivot joint 152, and is biased downwardly by a torsion spring 154. The force applied by the stabilizer 150 may press the underside of air filter 128 in to secure contact with the rim of the air inlet opening. The weight of the stabilizer and the strength of the torsion spring may be configured such that when the air filter is lifted from the collection chamber, the stabilizer does not overly deforms the shape of the air filter. In some embodiments, a mechanical limit to the rotation of the stabilizer may be implemented, for example at the pivot joint 152.

A conduit end does not have to be fully exposed to be considered to be an inlet opening that is not covered by a cover. For example, if the air inlet opening for a debris collection chamber is formed by an upright cylindrical column with a top circular rim, and an air filter is removed from a sufficient portion of the circular rim during vacuuming to permit flow of air and debris into the collection chamber, the air inlet opening may be considered to be not covered by the air inlet opening cover.

Figure 11:
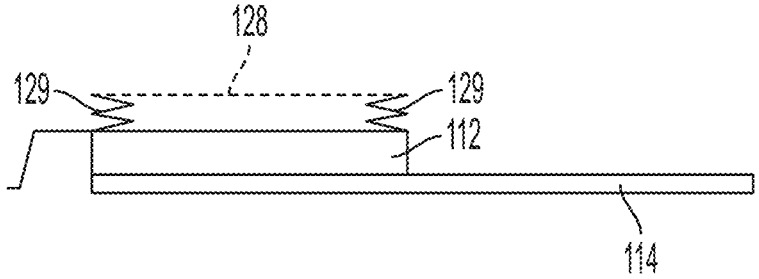
FIG. 11 is a cross-sectional side view of a cleaning head with a chamber inlet cover arrangement according to some embodiments.
Figure 12:
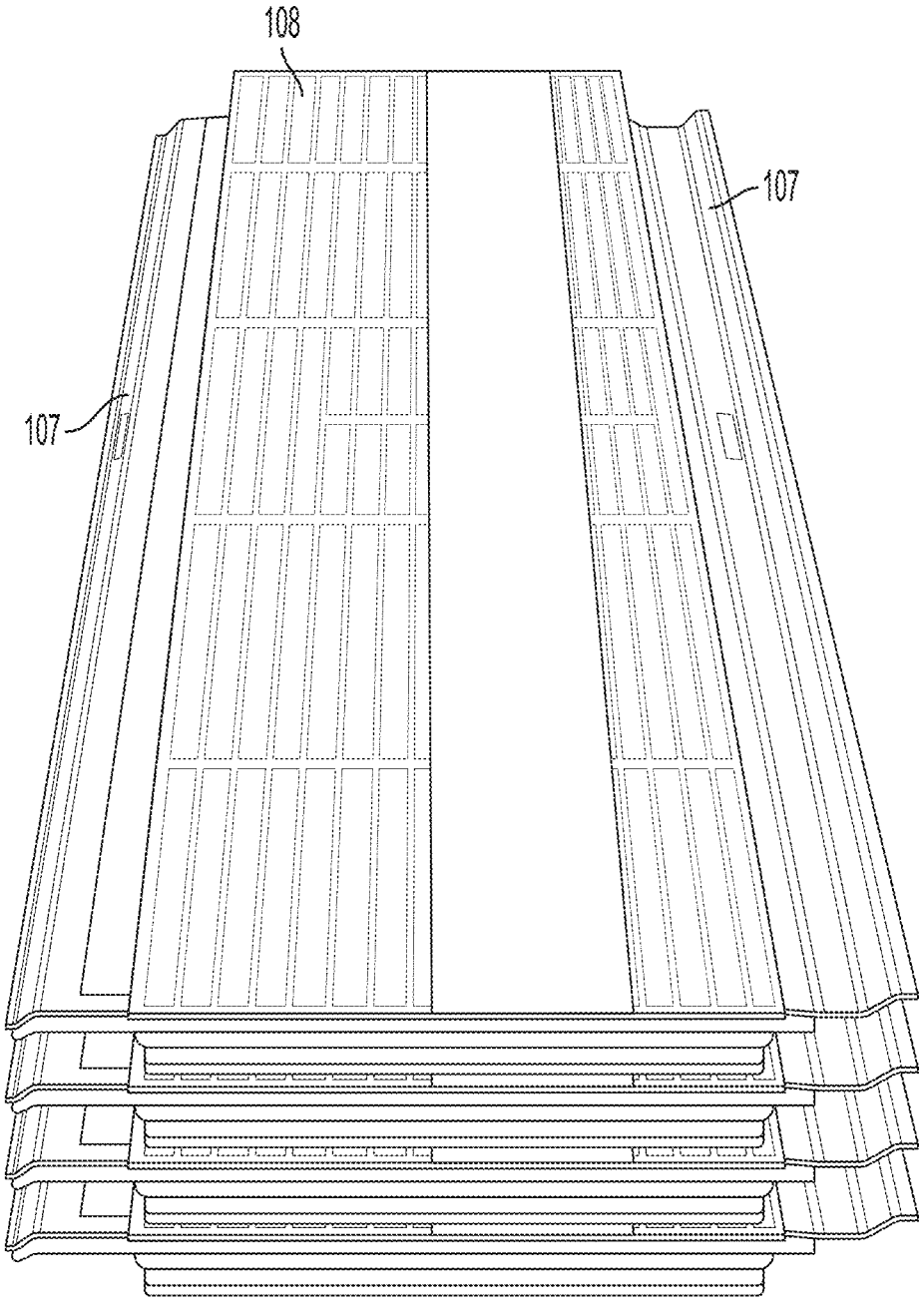
FIG. 12 shows eight stacked cleaning heads according to some embodiments.

As mentioned above, the air filter (or other collection chamber wall) may be connected to the collection chamber without any elastic connectors. FIG. 11 shows one embodiment where the air filter 128 is attached to the collection chamber with a pleated material 129. The air filter 128 is shown slightly lifted from the collection chamber in FIG. 11. When negative pressure is applied to the air filter, the air filter pulls on and unfolds the pleats. When the negative pressure is released, the pleats may be biased to return toward their folded position such that the air filter covers the chamber inlet opening. In some embodiments, a cover stabilizer, such as the stabilizer shown in FIG. 10, may be used in conjunction with a pleated arrangement or other non-elastic arrangement.

Instead of, or in addition to, using air filter 128 as the top wall of the collection chamber, the pleated material may be formed of an air filter material. For example, the top wall may be formed with an air impermeable material, and the vacuum cleaner may be configured to encompass at least the top wall and the pleated sides. When negative pressure is applied, the top wall is lifted upwardly, exposing the air filter material of the pleated sides. Air is then withdrawn from the collection chamber via the pleated sides.

While the embodiments illustrated herein show the air filter positioned such that the filter acts as a top wall of the collection chamber, the air filter may be positioned elsewhere on the collection chamber and still function as a removable cover for the chamber inlet opening. For example, instead of facing upwardly as shown in FIGS. 3-4, the chamber inlet opening may face rearwardly, and the air filter may be positioned at the back of the collection chamber. In the home position, the air filter may be held against the chamber inlet opening, for example with elastic connectors, to cover the inlet opening. When negative pressure is applied, the air filter be moved away from the chamber inlet opening.

In still other embodiments, more than one wall of the collection chamber may move in response to negative pressure. A movable wall may be a flexible bag structure. A wall is not necessarily required to be planar or rigid. For example, an entire debris collection chamber may be formed as a flexible bag attached to the chamber inlet opening. A portion of the bag may be positioned against the chamber inlet opening when no negative pressure is applied, and then as the bag expands from the application of negative pressure, the portion of the bag covering the chamber inlet opening moves away to allow debris-entrained air to enter the bag. As described herein, walls may be planar and/or rigid, and collection chambers may have a combination of rigid and flexible walls.

Applying a negative pressure to a collection chamber includes applying a negative pressure to the outside of an air permeable portion of the chamber and/or applying a negative pressure to an opening in the collection chamber.

In some embodiments, when the cleaning head is attached to the cleaning device, at least a portion of the debris collection chamber may be covered by the cleaning device. For example, in some embodiments, the debris collection chamber may be covered by the connector 106 used to connect the cleaning head to the cleaning device.

A divider 160 (see FIG. 4) may be provided to stiffen the collection chamber, though some embodiments include no such divider. Additional walls similar to divider 160 may be positioned in the collection chamber to guide air flow within the collection chamber.

Suction nozzle 107 may extend laterally along a front portion of the cleaning head. The suction nozzle may have any suitable shape and size. The suction nozzle may extend along an entire width of the cleaning head in some embodiments. Instead of being attached to the debris collection chamber, the suction nozzle may be formed on part of the vacuum cleaner device. In such an embodiment, once the collection chamber is attached to the vacuum cleaner, the suction nozzle forms a flow path to the collection chamber inlet opening.

The vacuum cleaner may include one or more actuators for actuating the suction source, and one or more actuators for actuating liquid application. The suction source may be an electric motor in some embodiments.

Cleaning heads described herein may be constructed and arranged to permit efficient packing in some embodiments. For example, the debris collection chamber and suction nozzle may be sized and positioned on a cleaning sheet and/or support structure such that an inverted cleaning head is stackable on an upright cleaning in such a manner that the upwardly-facing surface is substantially level. As can be seen in FIG. 11, eight cleaning heads 108 are stacked, and the cleaning heads alternate between being upright and being inverted. The suction nozzles 107 are sized and position to not interfere with the adjacently stacked cleaning heads.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An apparatus comprising:

a debris collection chamber having a bottom and a top, wherein the chamber top is movable relative to the chamber bottom;

an air filter configured to allow air to pass through the air filter while inhibiting debris from passing through the air filter;

a collection chamber inlet opening configured to allow debris-entrained air to flow into the collection chamber;

wherein the air filter forms at least a portion of the movable chamber top, and is movable from a first position, in which the air filter covers the chamber inlet opening, to a second position in which the air filter does not cover the chamber inlet opening wherein the air filter is adapted to be moved to the second position when negative pressure is applied to the air filter to draw air through the chamber inlet opening.

2. The apparatus as in claim 1, wherein the air filter forms at least a portion of a wall of the debris collection chamber, and the air filter allows air to pass out of the debris collection chamber.

3. The apparatus as in claim 2, wherein the collection chamber has a first volume when the air filter is in the first position, and the debris collection chamber has a second, larger volume when the air filter is moved to the second position.

4. The apparatus as in claim 3, wherein the air filter is adapted to be maintained in the first position when no negative pressure is applied to the air filter.

5. The apparatus as in claim 1, wherein the air filter is biased toward the first position when no negative pressure is applied to the air filter.

6. The apparatus as in claim 5, wherein the chamber top is connected to the collection chamber with a connector that biases the air filter toward the first position.

7. The apparatus as in claim 6, wherein the connector comprises an elastic material.

8. The apparatus as in claim 6, wherein the connector comprises a folded material.

9. The apparatus as in claim 1, wherein the chamber bottom comprises a rigid floor.

10. The apparatus as in claim 1, further comprising inlet walls extending upwardly from the chamber bottom, wherein the inlet opening is formed at least in part by a top rim of the inlet walls.

11. The apparatus as in claim 1, further comprising a cleaning head, wherein the collection chamber is attached to the cleaning head.

12. The apparatus as in claim 11, wherein the collection chamber is permanently attached to the cleaning head.

13. The apparatus as in claim 11, wherein the cleaning head includes a suction nozzle, and an air flow path connects the suction nozzle to the chamber inlet opening.

14. The apparatus as in claim 13, wherein the suction nozzle and the collection chamber are integrally formed as a unitary piece.

15. The apparatus as in claim 11, further comprising a cleaning pad attached to the cleaning head.

16. The apparatus as in claim 1, further comprising an inlet leading to the chamber inlet opening, wherein the inlet has a slanted floor.

17. The apparatus as in claim 1, wherein the collection chamber has no openings other than the inlet opening.

18. An apparatus adapted to be attachable to a vacuum cleaner, the apparatus comprising:

a debris collection chamber having a bottom and a top, wherein the chamber top is movable relative to the chamber bottom;

a collection chamber inlet opening configured to allow debris-entrained air to flow into the debris collection chamber;

an air filter forming at least a portion of the movable chamber top, and configured to allow air to pass through the air filter while inhibiting debris from passing through the air filter;

a cover movable from a first position in which the cover covers the chamber inlet opening, to a second position in which the cover does not cover the chamber inlet opening;

wherein the cover is attached to the air filter, and the air filter is arranged such that when the air filter is under no negative pressure, the cover is in the first position, and the air filter is arranged such that when negative pressure is applied to the air filter to draw air through the chamber inlet opening, the air filter moves the cover to the second position.

19. An apparatus adapted to be attachable to a cleaning device having a suction source, the apparatus comprising:

a debris collection chamber having a bottom and a top, wherein the chamber top is movable relative to the chamber bottom, and having a chamber wall that moves when negative pressure is applied to the collection chamber;

a collection chamber inlet opening configured to allow air to flow into the debris collection chamber when negative pressure is applied to the debris collection chamber;

a cover forming at least a portion of the movable chamber top, and movable from a first position, in which the cover covers the chamber inlet opening, to a second position in which the cover does not cover the chamber inlet opening;

wherein the cover is attached to the chamber wall and arranged such that when the chamber wall moves due to the negative pressure being applied the collection chamber, the chamber wall moves the cover from the first position to the second position in which the cover does not cover the chamber inlet opening, and a flow path is opened for debris-entrained to be drawn into the collection chamber through the chamber inlet opening.

* * * * *